US008321964B2

(12) United States Patent
Gernes

(10) Patent No.: US 8,321,964 B2
(45) Date of Patent: Dec. 4, 2012

(54) GARMENT WITH POCKET

(76) Inventor: Sarah Jane Gernes, St. Paul, MN (US)

( * ) Notice: Subject to any disclaimer, the term of this patent is extended or adjusted under 35 U.S.C. 154(b) by 232 days.

(21) Appl. No.: 12/436,083

(22) Filed: May 5, 2009

(65) Prior Publication Data

US 2010/0281595 A1 Nov. 11, 2010

(51) Int. Cl.
*A41B 9/02* (2006.01)

(52) U.S. Cl. ..... 2/400; 2/247; 2/403; 2/406

(58) Field of Classification Search ..... 2/67, 247, 2/250, 400–406; D2/716, 712, 713; 450/150
See application file for complete search history.

(56) References Cited

U.S. PATENT DOCUMENTS 1,397,570 A * 11/1921 Bott ..... 450/150
D116,817 S * 9/1939 Dietz ..... D2/716
2,492,862 A * 12/1949 Harvey ..... 450/89
2,544,840 A * 3/1951 Kowatsch ..... 2/67
2,725,573 A * 12/1955 Kornhauser ..... 2/247
2,822,807 A * 2/1958 Heyman ..... 602/67
2,854,669 A * 10/1958 Cohen ..... 2/67
3,459,181 A 8/1969 Mann
3,871,030 A 3/1975 Green
D283,077 S * 3/1986 Crandall ..... D2/738
4,899,395 A 2/1990 Spector
5,067,178 A * 11/1991 Katchka ..... 2/250
5,093,935 A * 3/1992 Countee, Jr. ..... 2/400
5,172,430 A * 12/1992 Lerma-Solis ..... 2/400
D339,219 S * 9/1993 Beauchemin ..... D2/713
5,241,710 A 9/1993 Lockhart
5,255,392 A * 10/1993 Stanislaw ..... 2/247
D341,470 S * 11/1993 Quick ..... D2/713
5,460,188 A * 10/1995 Barrett, Sr. ..... 128/842
D382,386 S * 8/1997 Malone ..... D2/738
D384,487 S * 10/1997 Ingels ..... D2/716
5,678,251 A 10/1997 Getz
D387,538 S * 12/1997 Taylor et al. ..... D2/716
5,707,364 A 1/1998 Coates
D396,542 S * 8/1998 Nicholson ..... D2/716
5,920,914 A 7/1999 Dempsey
6,018,823 A * 2/2000 Ortmeier ..... 2/406
6,076,195 A 6/2000 Klein
(Continued)

OTHER PUBLICATIONS

Sinasohn, Roger.. Parent Dish, *Swanky or Spanky—underwear with a built-in-condom pocket*, Feb. 26, 2007. AOL Living <http://www.parentdish.com/search/?q=swanky+or+spanky>.

*Primary Examiner* — Khoa Huynh
*Assistant Examiner* — Richale Quinn
(74) *Attorney, Agent, or Firm* — Clise, Billion & Cyr, P.A.

(57) ABSTRACT

A garment, for example, an undergarment, that includes a pocket is described. The pocket is positioned on the interior of the garment and can be positioned against the wearer's body. The pocket is generally aligned with the centerline of the wearer's body. In an example, the garment includes a body to partially cover the wearer's body. The body includes a rear panel substantially aligned with a center line of the wearer's body. The rear panel includes an interior face to be proximal the wearer and an exterior face to be distal the wearer. A supporting band is to support the body generally at a waist of the wearer. The pocket can be positioned on either the supporting band or the rear panel or both. The pocket is designed to store small or flat objects in a manner that is essentially invisible outside the wearer's clothes.

12 Claims, 4 Drawing Sheets

U.S. PATENT DOCUMENTS

| | | | |
|---|---|---|---|
| 6,092,240 | A | 7/2000 | Weller |
| 6,178,559 | B1 | 1/2001 | Dennis et al. |
| 6,308,340 | B1 | 10/2001 | Cook |
| 6,363,538 | B1 | 4/2002 | Davis |
| 6,772,446 | B1 | 8/2004 | Black |
| D530,884 | S | 10/2006 | Johnson-Smith |
| D553,826 | S | 10/2007 | Austin |
| D559,501 | S | 1/2008 | Austin |

* cited by examiner

GARMENT WITH POCKET

FIELD

The present disclosure relates to a garment with a pocket and, more particularly, to an undergarment or garment to be worn against the wearer's skin with an interior pocket.

BACKGROUND

People have needed pockets to carry things since humans began wearing clothes. Various attempts at providing pockets in undergarments have been made.

U.S. Pat. No. 6,018,823 shows a women's undergarment with rear pouch including a body portion adapted for being worn about a trunk of a wearer below a waist thereof. The body portion includes a front portion and a back portion fabricated of a four way stretch fabric. The back portion includes an interior layer and an exterior layer. A four way stretch fabric band is provided that is adapted for being worn about a waist area of a wearer. The four way stretch fabric band is secured to the body portion. The back portion of the body portion has a pocket formed thereon. The pocket receives a microphone pack therein.

U.S. Pat. No. 6,308,340 shows a women's underpant with an inside pocket and includes an inner panel attached to the inside of the front portion to form a pocket inside the underpants.

Design Pat. Nos. 341,470; 384,487; 530,884; 559,501 show an ornamental designs for pocketed underwear.

SUMMARY

A garment including a part to be worn against the wearer's skin includes a pocket. The pocket is positioned on the interior of the garment and can be positioned against the wearer's body. In an example, the garment includes a garment body to partially cover the wearer's body. The garment body includes a rear panel substantially aligned with a center line of the wearer's body. The rear panel includes an interior face to be proximal the wearer and an exterior face to be distal the wearer. A supporting band is to support the garment body generally at a waist of the wearer. The pocket is positioned at least partially on the interior face of the garment body. In an example, the supporting band and the body are joined by stitching that is visible on the interior face of the body. In an example, the pocket includes an opening that is positioned below the supporting band such that the wearer must reach past the supporting band to access the pocket. In an example, the pocket includes a closure to close the opening. In an example, the pocket is positioned on the top half of the rear panel. In an example, the pocket is fixedly sewn onto the interior face of the rear panel. In an example, the pocket is on or substantially centered on the center line of the wearer's body. In an example, the pocket is at least partially on an interior of the supporting band. In an example, the pocket is generally aligned with a centerline of the body of the wearer.

The pocket is adapted, in an example, to hold an article therein in a generally flat manner such that the article in the pocket is substantially invisible outside clothing of the wearer. The pocket can hold a variety of articles such as, but not limited to a electronic devices, credit card, identification card, paper currency, a condom, a feminine hygiene article, an insulin pump, a key, and a medical device.

The garment can be designed in a plurality of shapes. Examples of these shapes for use as undergarments include briefs, boy shorts, french-cut, thong, hipster, and bikini. Other shapes can include swimming shorts, running clothes, compression shorts, etc.

The pocket, in examples, includes an opening that allows a wearer to access the pocket and the contents therein. The opening can be positioned on an interior face of the supporting band. In an example, the opening extends through the supporting band and, hence, provides access from the exterior of the undergarment. In an example, a closure is provided to close the opening.

In an example, the undergarment body includes an exterior pocket on its exterior face. The exterior pocket can be placed on the front of the undergarment. In an example, the supporting band acts as a closure for the pocket.

In an example, the pocket extends on the interior face of the rear part of the garment body.

In an example, the pocket is entirely beneath the supporting band.

It will be understood that any of the examples described in this section are combinable with any other example.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

BRIEF DESCRIPTION OF THE DRAWINGS

Embodiments are illustrated by way of example and not limitation in the figures of the accompanying drawings, in which like references indicate similar elements and in which.

DETAILED DESCRIPTION

Example methods and systems for an undergarment with a pocket are shown and described. In the following description, for purposes of explanation, numerous specific details are set forth in order to provide a thorough understanding of example embodiments. It will be evident, however, to one skilled in the art that the present invention may be practiced without these specific details.

Figure 1:
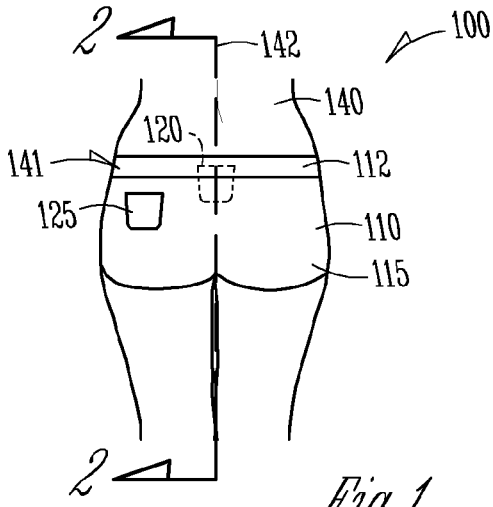
FIG. 1 is a rear view of a garment according to an example embodiment of the present invention.

FIG. 1 shows an garment 100 for a person to wear on their body 140. The garment can be an undergarment or other garment that is at least partially worn directly against the wearer's skin. In the case of an undergarment, it have various shapes and styles such as, but not limited to, briefs, boy shorts, thongs, hipster, French cut, control top, etc. An undergarment covers the body from about the waist down to at least the groin. The undergarment is typically adapted to cover the genitalia of the wearer. Undergarment can further cover the posterior, e.g., gluteus maximus muscles and anus, of the wearer. In an example, the garment 100 extends down the wearer's body no further than onto the wearer's thighs. The garment 100 is usually worn next to the wearer's skin as the first layers of clothing. Accordingly, the garment 100 is comprised of a light fabric and snugly fits against the wearer's body.

Garment 100 includes a garment body 110 supported by a supporting band 112. The supporting band 112 is designed to extend around the wearer's waist 141. Band 112 includes an elasticized component to hold the undergarment on the waist of the wearer. Band 112 can further include a fabric or thread component to provide a look and a feel for the waist encircling band 112. The fabric component can be lace. In an example, the band 112 with both the fabric component and the elastic component has a lace appearance. In an example, the lace appearance includes apertures that extend through the band 112. In an example, the lace appearance is on the outside of the band and the part adjacent the wearer's skin is a more solid fabric. Examples of an elastic component are thermoplastic polyurethane tape, spandex, Lycra™, certain nylons, rubber, nylon, elastane and lurex elastic, etc. The band can be a woven elastic component that is faced by more comfortable material in contact with the skin such as certain smooth man-made fabrics, satin, silk, and/or cotton. The circumference can be made to various lengths as people from children to adults vary in waist size. The width of the band 112 can vary from about ¾ inch to about 4 inches, +/−⅛ inch. In a specific example, the band 112 has a width of about 2.75 inches to about 3.25 inches, +/−⅛ inch.

In use, the band 112 is stretched from its natural, at-rest position to a worn position. In an example, the stretch can be from 0.25 inch to about 2 inches. As is the nature of elastic, the band 112 tries to return to its natural position, i.e., Hooke's law, which states that Force due to elastic=−c*extension of the elastic, where c is the coefficient of elasticity of the elastic and the extension of the elastic is the stretched length of the elastic (around the waist of the wearer) minus its unstretched length (natural length). However, the wearer's waist prevents the band from returning to the natural position and, hence the band 112 exerts a force on the waist to hold the garment 100 in position on the wearer.

The garment body 110 includes a rear panel 115 to cover the posterior portion of the wearer. The posterior portion can include the gluteus maximus muscles and anus, and parts thereof, of the wearer. The rear panel 115 is joined to at least one front panel (not shown in FIG. 1) to define the body 110. In an example, the front and rear panels are joined generally at the wearer's hips and a crotch panel connects to both the front and rear panels and extends to cover the crotch and genitals of the wearer. The crotch panel can include a breathable fabric such as cotton. In an example, the garment body 100 has side seams or is seamless.

The rear panel 115 is usually cut to be symmetrical about a centerline when the garment 100 is sewn. Such a centerline extends vertically relative to the view shown in FIG. 1. If the undergarment is of quality construction, the centerline of the rear panel 115 is generally aligned with the mid-sagittal plane 142 of the wearer. The phrase "mid-sagittal plane" is the sagittal plane running through the midline of the wearer. Stated another way, the mid-sagittal plane 142 divides the wearer's body into two halves (left and right) of equal portions, assuming the wearer has bilateral symmetry. As most people do not have perfect bilateral symmetry, i.e., they are not perfectly proportioned on each side, some variation may occur from person to person but the mid-sagittal plane is generally positioned the same for most people. The mid-sagittal plane 142 passes through the wearer's midline anatomy, such as the navel and spine and intermediate the gluteus maximus muscles. The mid-sagittal plane extends into and out of the paper as shown in FIG. 1. The centerline of the rear panel 115 lines in the mid-sagittal plane 142. In an example, the centerline of the rear panel 115 is within about one centimeter of the sagittal plane 142.

A pocket 120 is provided on the garment 100. The pocket 120 is positioned such that at least a portion of the pocket is on the interior face of the band 112. In an example, the opening of the pocket is on the band's interior face. The pocket 120 defines an interiorly-open pouch and can extend past the band 112 on onto the interior face of the rear panel 115. The pocket 120 overlays the mid-sagittal plane 142. In an example, the pocket 120 is designed to be symmetrical about the centerline of the rear panel 115. In this example, the pocket 120 has its centerline positioned on the mid-sagittal plane of the wearer when the garment 100 is worn.

The pocket 120 and/or the rear panel 115 can be formed from an elastic material. In an example, the elastic material is a blend of spandex or elastane, e.g., Lycra™, and other fibers. The spandex can be from about 5% to about 25% of the number of fibers or the by weight of the elastic material. This will allow the pocket 120 and/or rear panel 115 to stretch slightly to cover the wearer's body with a snug, yet comfortable fit. Moreover, the pocket 120 can stretch to accommodate an article that is the same size or slightly larger than the pocket's natural, unstretched state. The pocket 120 in its stretched state will exert an elastic force on the article stored in the pocket to secure the article therein. Moreover, the stretched state of the pocket 120, the band 112, and rear panel 115 will force the article and pocket gently into the small of the wearer's back, which typically is a hollow or recess defined by above the sacrum and between the hip bones. This slight pressing results in a generally smooth outer surface in the undergarment 100 over the pocket 120 such that the pocket and article therein are substantially invisible outside the wearer's clothes.

An optional outer pocket 125 can be provided on the exterior face of the rear panel. However, an outer pocket 125 may not be substantially invisible outside the wearer's clothes.

Figure 2:
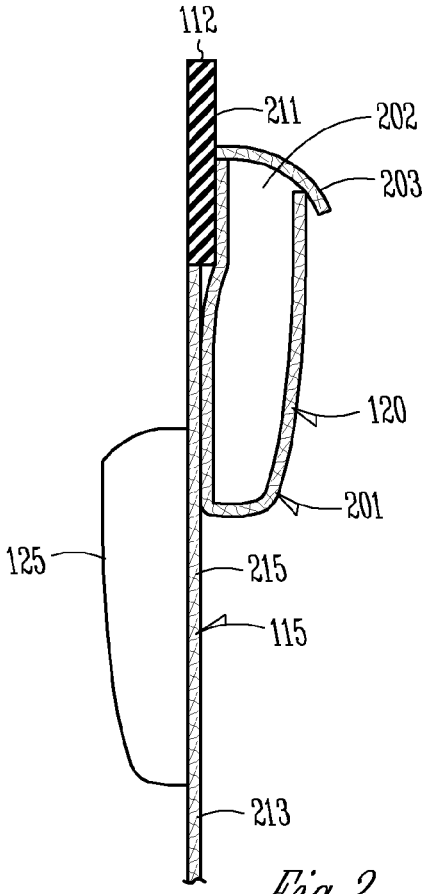
FIG. 2 is a cross sectional view taken generally along line 2-2 of FIG. 1 of a garment according to an example embodiment of the present invention.

FIG. 2 shows a partial cross sectional view of the garment 100 taken generally along line 2-2 of FIG. 1. The pocket 120 is fixed to the interior face 211 of the supporting band 112. The pocket 120 is optionally fixed to the interior face 213 of the rear panel 115. The outer pocket 125 is fixed to the exterior face 215 of the rear panel 115. The pocket 120 includes a pouch 201 that is U-shaped in cross section to define an interstice in which articles can be positioned. The open top 202 of the pouch 201 is closed by a closure 203. The closure 203 is a flap with one side fixed to either the band 112 or a leg (rightward in FIG. 2) of the pouch 201. In an example, the pouch 201 is defined by a single leg of fabric or mesh that is attached on three sides to the rear panel interior face 213.

To fabricate the pocket 120, the following example can be used. A piece of fabric to form the pocket 120 is cut from a swath of fabric with additional fabric allowance for a top hem and stitching on three sides. The pocket piece 201 is then pressed or ironed on the three non-hem sides. The pocket piece 201 is then positioned on the rear panel 115 of the undergarment 100. The hem is stitched, e.g., topstitched. The remaining three sides are fixed, e.g., adhered, glued, or stitched to the rear panel 115. A top closure flap 203 can be sewn along the upper edge of the pocket piece 201. The trim seam allowance can be about ¼ inch. In an example, the closure of the pocket is an elasticized hem at the top opening of the pocket.

Figure 3:
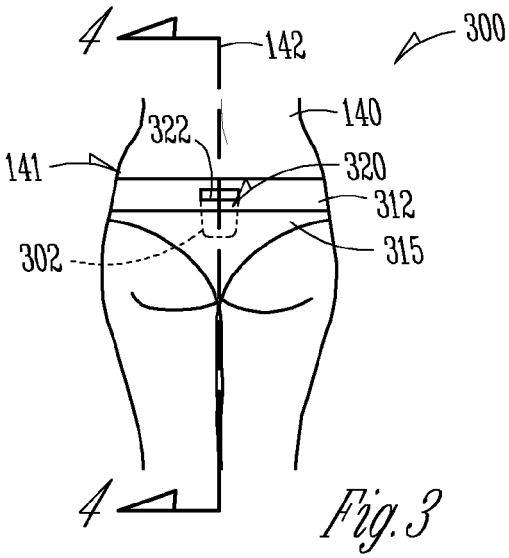
FIG. 3 is a rear view of a garment according to an example embodiment of the present invention.

FIG. 3 shows another example of the garment 300 with pocket 320. The garment 300 can be an undergarment. The reference numbers to the example embodiment shown in FIG. 3 are similar references numbers to the other embodiments described herein with the most significant digit changed to a "3." Garment 300 includes a garment body 310 supported by a supporting band 312. The supporting band 312 is designed to extend around the wearer's waist 141 to secure the garment 300 in place on the wearer's body 140. Band 312 includes an elasticized component to hold the wearer's body and can include a fabric or thread component to provide a look and a feel for the waist encircling band 312. The band 312 can have a width, measured vertically in FIG. 3 of greater than 1 inch. In an example, the band 312 has a width of greater than 2 inches. In an example, the band has a width of greater than 2.75 inches. In an example, the band has a width of less than 3.25 inches.

The body 310 of the garment 300 is different in its shape from the FIG. 1 example in that the rear panel 315 has a higher cut, e.g., the rear panel does not fully cover the buttocks and hips of the wearer. Otherwise the rear panel 315 is substantially the same as the rear panel 115 described above. Specifically, the rear panel 315 is cut to be symmetrical about a centerline when the garment 300 is sewn. Such a centerline extends vertically relative to the view shown in FIG. 3. If the undergarment 100 is of quality construction, the centerline of the rear panel 315 is generally aligned with the mid-sagittal plane 142 of the wearer. The centerline of the rear panel 315 lines in the mid-sagittal plane 142.

The pocket 320 is positioned at least partially under the support band 312. The pocket opening 322 extends through the band 312. Hence, the pocket 320 is accessible from the exterior of the garment 300. The pocket 320 further includes a pouch 301 that opens at the opening and defines a closed interstice or space in which articles can be stored.

The band 312 can act as the closure of the pocket 320 as the portion of the band 312 beneath the opening 322 provides an elastic force against the pouch and the wearer's body.

The pocket 320 is positioned such that at least a portion of the pocket is on the interior face of the band 312. In an example, the opening 322 of the pocket is on the band's exterior face. The pocket 320 defines an exteriorly-open pouch and can extend past the band 312 on onto the interior face of the rear panel 315. The pocket 320 overlays the mid-sagittal plane 142. In an example, the pocket 320 is designed to be symmetrical about the centerline of the rear panel 315. In this example, the pocket 320 has its centerline positioned on the mid-sagittal plane of the wearer when the garment 300 is worn.

Figure 4:
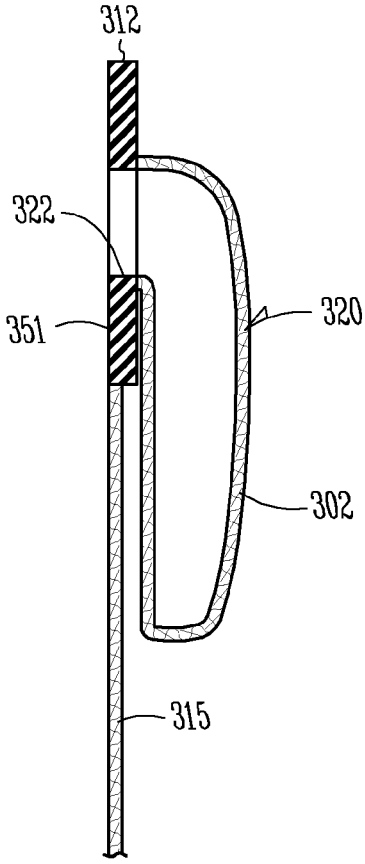
FIG. 4 is a cross sectional view taken generally along line 4-4 of FIG. 3 of a garment according to an example embodiment of the present invention.

FIG. 4 is a cross sectional view taken partially along line 4-4 of FIG. 3. The pocket 320 has an opening 322 through the band 312. The lower part 351 of the band 312 can act as a closure to the portion of the pouch 302 below the lower band part 351. The materials of the pouch 320 can be the substantially similar to those described above.

Figure 5:
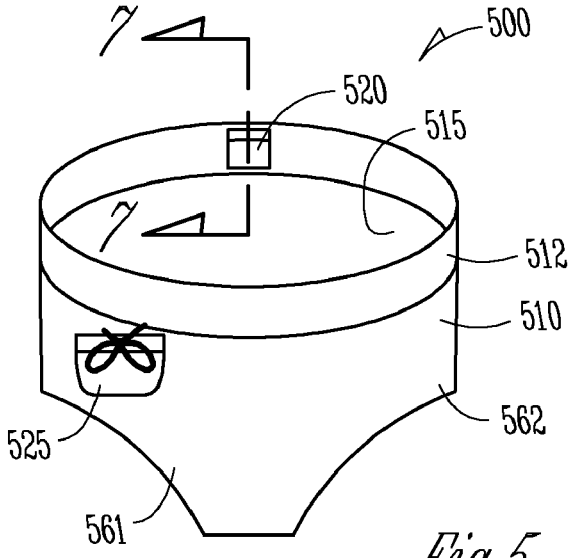
FIG. 5 is a perspective view of a garment according to an example embodiment of the present invention.
Figure 6:
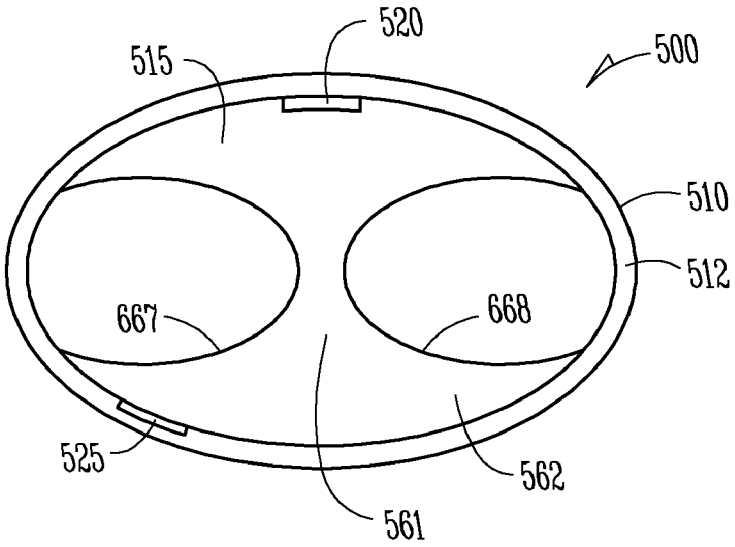
FIG. 6 is a top view of a garment according to an example embodiment of the present invention.

FIG. 5 shows a front, top perspective view of an example garment 500. The garment 500 can be an undergarment. The reference numbers to the example embodiment shown in FIG. 5 are similar references numbers to the other embodiments described herein with the most significant digit changed to a "5." Garment 500 includes a body 510 supported by a supporting band 512. The supporting band 512 is designed to extend around the wearer's waist 141 to secure the garment 500 in place on the wearer's body (not shown in FIG. 5). The undergarment body 510 includes rear panel 515 and two front panels 561, 562. The panels 515, 561, and 562 define two leg holes 667, 668 as shown in FIG. 6.

A pocket 520 is provided on the undergarment 500. The pocket 520 is positioned such that the entirety is on the interior face of the band 512. None of the pocket 520 extends down onto the rear panel 515 of the undergarment body. In an example, the opening of the pocket is on the band's interior face. The pocket 520 defines an interiorly-open pouch. The pocket 520 overlays the wearer's mid-sagittal plane 142. In an example, the pocket 520 is designed to be symmetrical about the centerline of the rear panel 515. In an example, the pocket 520 has its centerline positioned on the mid-sagittal plane of the wearer when the undergarment 500 is worn. The pocket 520 can be sewn onto the band 512 on three sides (the two vertical and bottom) to define the pouch to hold articles therein.

The pocket 520 can be formed from an elastic material. In an example, the elastic material allows the pocket 520 to stretch slightly to hold an article against the wearer's body with a snug, yet comfortable fit. Moreover, the pocket 520 can stretch to accommodate an article that is the same size or slightly larger than the pocket's natural, unstretched state. The pocket 520 in its stretched state will exert an elastic force on the article stored in the pocket to secure the article therein. Moreover, the stretched state of the pocket 520 and the band 512 will force the article and pocket gently into the small of the wearer's back, which typically is a hollow or recess defined by above the sacrum and between the hip bones. This slight pressing results in a generally smooth outer surface in the garment 500 over the pocket 520 such that the pocket and article therein are substantially invisible outside the wearer's clothes. Substantially invisible results in a person not being able to see the article or pocket through the wearer's clothes with just a casual look or glance.

An optional outer pocket 525 can be provided on the exterior face of one of the front panels 561, 562, as shown on front panel 561. However, an outer pocket 525 may not be substantially invisible outside the wearer's clothes.

Figure 7:
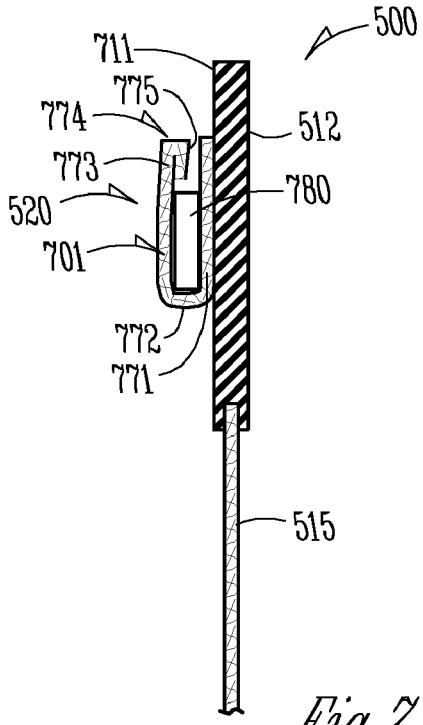
FIG. 7 is cross sectional, partial view of a garment according to an example embodiment of the present invention.

FIG. 7 shows a cross section of the part of the garment 500 including the supporting band 512 to which is fixed, for example, by sewing, adhesion, or gluing, a fabric rear panel 515. A pocket 520 is also fixed to the interior face of the supporting band 512 in a manner such that the pocket at least partially overlies the center line of the wearer when the garment is worn. In an example, the pocket is laterally centered on this center line. About half of the pocket 520 is on both a left half of the garment and a right half of the garment. The pocket 520 is completed positioned on the supporting band and does not extend downwardly onto the rear panel. However, the pocket could extend downwardly onto the panel as the present disclosure is not limited to being under the supporting band unless explicitly claimed. In an example, the pocket 520 has a greater width along the circumference of the interior of the supporting band than a height in the vertical direction of the supporting band 512.

Pocket 520 has a general U-shape (in cross section) pouch 701 with a first leg 771 of the U-shape being against the supporting band 512. A web 772 extends inwardly relative to the wearer (and leftwardly as shown in FIG. 7) and joins to the second leg 773 that extends upward thereby defining a top-opening recess in which is held an article 780. A closure 774 is formed at the top of the second leg 773 by holding a top part 775 of the second leg 773 back down into the open-top recess. In an example, the top part 775 includes an elastic.

In a further example, pocket 520 includes the 701 described herein but without the first leg 771. The web 772 forms the closed bottom of the pocket 520 and the leg 773 forms the inward face and the two upward, closed sides as well as the open top. In a further example, a single panel of fabric forms both the web 772 and the leg 773. In this example, the band 512 or a part of the garment itself forms one side of the pocket 520.

Figure 8:
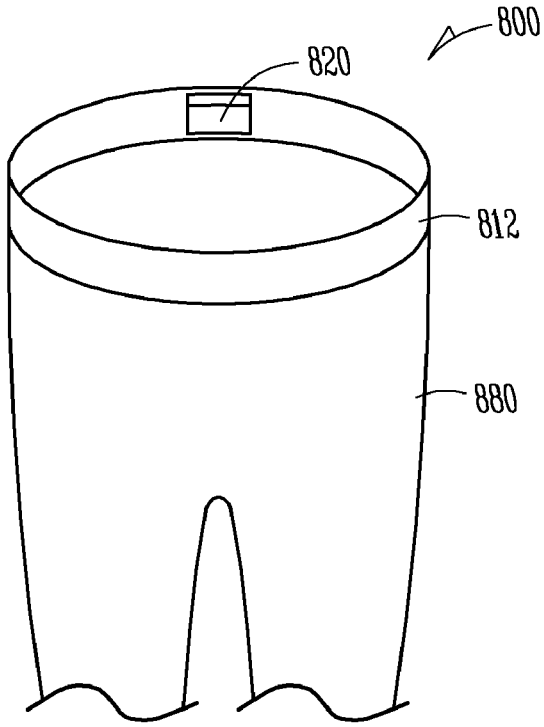
FIG. 8 is a view of a garment according to an example embodiment of the present invention.

FIG. 8 shows a further garment 800 that includes a pocket 820. Pocket 820 can be similar to any pocket described herein and its equivalents as allowed by law. A supporting band 812 is fixed to a body covering 880 that extends over a significant part of a wearer's body. The garment 800 can be an undergarment over which other clothes are worn. In an example garment 800 is both an garment to be worn against the wearer's skin and be visible to others. One example of such a garment is running pants, which extend from the waist to the wearer to the ankles. Other examples include swimming suits and tights. Current performance swimming suits can extend from the shoulders to the ankles or mid thigh. Other swimming suits are covering the mid-body only from just below the waist to the genitalia. The body covering 880 can be a form fitting material that includes spandex, spandex, Lycra™, certain nylons, rubber, nylon, elastane and lurex and other athletic clothing materials.

The present inventor discovered the need for an improved garment, particularly a garment to be at least partially against the wearer's skin such as an undergarment, to meet the needs of today's woman. The inventor determined that there is a desire to be comfortable and fashionable undergarments that provide storage. However, the current undergarments and prior designs lacked the feature of a pocket that is substantially invisible outside the wearer's clothes. As a result the present invention is directed to a pocket placed in the rear of the underwear. In an example, the pocket is positioned below the small of the wearer's back on the inside of the garment, such as an undergarment. The pocket can be against the wearer's skin. In an example, the pocket is beneath the supporting band of the undergarment. In another example, the pocket can extend downwardly from the supporting band to the rear panel of the undergarment body. The design of the undergarment results in the undergarment holding items in the pocket in a substantially invisible manner even with today's fabric and fashions.

In use, the wearer of the garment 100, 300, or 500 can securely store small articles in the pocket. Examples of articles that can be stored include, but are not limited to electronic devices such as IPODs, MP3 players, or other music players, credit card, identification card, paper currency, a condom, a feminine hygiene article, an insulin pump, and a medical device. Thus, the wearer can carry identification in a secure manner when jogging, hiking, visiting a club, among others. The pocket is further designed to store keys, such as a locker room key, automobile key, house key, etc., in a comfortable and flat manner that is essentially invisible outside the garment or the wearer's clothes. Moreover, storing articles in the undergarment pocket provides security for the article.

While the term "undergarment" is used in the present description, there are other names for such lower torso garment, in particular for female apparel. Examples of terms for undergarments include panties in the USA and Canada or knickers or pants in the UK or undies in Australia and New Zealand. Such female underwear is usually light and snug-fitting, designed to be worn by women or girls in the area directly below the waist.

This has been a detailed description of some exemplary embodiments of the invention(s) contained within the disclosed subject matter. Such invention(s) may be referred to, individually and/or collectively, herein by the term "invention" merely for convenience and without intending to limit the scope of this application to any single invention or inventive concept if more than one is in fact disclosed. The detailed description refers to the accompanying drawings that form a part hereof and which shows by way of illustration, but not of limitation, some specific embodiments of the invention, including a preferred embodiment. These embodiments are described in sufficient detail to enable those of ordinary skill in the art to understand and implement the inventive subject matter. Other embodiments may be utilized and changes may be made without departing from the scope of the inventive subject matter. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

It is emphasized that the Abstract is provided to comply with 36 C.F.R. §1.62(b) requiring an Abstract that will allow the reader to quickly ascertain the nature and gist of the technical disclosure. It is submitted with the understanding that it will not be used to interpret or limit the scope or meaning of the claims.

I claim:

1. A garment, comprising:

an undergarment to fit snugly against and partially cover a body of a wearer, wherein the undergarment includes a rear panel substantially aligned with a center line of the body of the wearer, the rear panel including an interior face to be proximal the wearer and an exterior face to be distal the wearer;

a supporting band to support the undergarment generally at a waist of the wearer, the supporting band comprising an elasticized component; and a pocket at least partially on the interior face of the undergarment and overlying the centerline and aligned with the mid-sagittal plane of the wearer, wherein the pocket lies against the wearer's back between the hollow or recess of the wearer's body, located below the waist, above the sacrum and between the hip bones;

wherein the pocket includes an opening that is positioned at an interior face of the supporting band, wherein the pocket is to hold an article therein in a generally flat manner such that an article in the pocket is substantially invisible outside the clothing of the wearer; and wherein the supporting band provides an elastic force against the pocket to close the pocket opening, wherein a portion of the pocket is fixedly sewn onto the interior face of the rear panel.

2. The garment of claim 1, further comprising a front panel.

3. The garment of claim 1, wherein the pocket is to hold at least one of a group consisting essentially of a credit card, identification card, paper currency, a condom, a feminine hygiene article, an insulin pump, and a medical device.

4. The garment of claim 1, wherein the garment has a generally boy short shape with a unitary rear panel.

5. The garment of claim 1, wherein the pocket is substantially centered on the center line of the wearer's body.

6. The garment of claim 1, wherein the pocket is adjacent to the wearer's skin and wherein the opening extends through the interior face of the supporting band and is accessible through the supporting band.

7. The garment of claim 1, further comprising an exterior pocket on the exterior face.

8. The garment of claim 1, wherein the pocket extends on the interior face of the rear part of the underpant.

9. The garment of claim 2, wherein the supporting band is joined to the front panel and the rear panel by stitching that is visible on the interior face of the undergarment body, and wherein the pocket is at least partially positioned beneath the supporting band.

10. A garment, comprising:

an underpant to at least partially cover a lower body of a wearer, the underpant including a rear part that includes an interior face to be proximal the wearer and an exterior face to be distal the wearer;

a supporting band to support the underpant on the wearer, the supporting band comprising an elasticized component; and a pocket at least partially on an interior of the supporting band and to be generally aligned with a centerline of the body of the wearer, and with the mid-sagittal plane of the wearer;

wherein the pocket lies against the wearer's back between the hollow or recess of the wearer's body, located below the waist, above the sacrum and between the hip bones;

wherein the pocket includes an opening that is positioned at an interior face of the supporting band; and wherein the supporting band provides an elastic force against the pocket to close the pocket opening, wherein the entire pocket is fixedly secured on the interior of the supporting band such that the pocket does not extend below the supporting band.

11. The garment of claim 10, wherein the garment generally has a thong shape.

12. The garment of claim 10, wherein the pocket is to hold an article therein in a generally flat manner such that an article in the pocket is substantially invisible outside the clothing of the wearer.

* * * * *